United States Patent [19]

Billberg

[11] Patent Number: 4,573,957

[45] Date of Patent: Mar. 4, 1986

[54] SYSTEM FOR THE TRANSPORT AND RAISING OF PACKING CONTAINER BLANKS

[75] Inventor: Alf Billberg, Oxie, Sweden

[73] Assignee: Tetra Pak International AB, Lund, Sweden

[21] Appl. No.: 583,201

[22] Filed: Feb. 24, 1984

[30] Foreign Application Priority Data

Mar. 1, 1983 [SE] Sweden ..... 8301122

[51] Int. Cl.[4] ..... B31B 1/78

[52] U.S. Cl. ..... 493/309; 493/319; 493/310

[58] Field of Search ..... 493/309, 310, 318, 319; 53/566

[56] References Cited

U.S. PATENT DOCUMENTS

| | | | |
|---|---|---|---|
| 1,219,427 | 3/1917 | Beckmann . | |
| 1,275,759 | 8/1918 | Russell | 493/319 |
| 2,291,010 | 7/1942 | Vergobbi | 493/310 |
| 3,058,271 | 10/1962 | McGihon | 493/309 |
| 3,064,543 | 11/1962 | Peters | 493/310 |
| 3,368,462 | 2/1968 | Guzzardo | 493/310 |

FOREIGN PATENT DOCUMENTS 2747359 5/1978 Fed. Rep. of Germany .

*Primary Examiner*—Daniel C. Crane
*Assistant Examiner*—David B. Jones
*Attorney, Agent, or Firm*—Burns, Doane, Swecker & Mathis

[57] ABSTRACT

A system for the transport and raising of packing container blanks to be utilized in packing machines which convert flattened, tubular packing container blanks to filled and closed packages. A simple and space-saving arrangement of this invention comprises gripping elements (10) placed along a conveyer (5) which in a continuous movement take up a blank (1) from the conveyer and raise the same to a square cross-section and pass it on in raised position.

23 Claims, 9 Drawing Figures

SYSTEM FOR THE TRANSPORT AND RAISING OF PACKING CONTAINER BLANKS

FIELD OF THE INVENTION

The present invention relates to an arrangement for the transport and raising of flattened, tubular packing container blanks.

BACKGROUND AND DISCUSSION OF THE PRIOR ART

Packing containers of the non-returnable type are often used at present for the packaging of a great number of different products, e.g. beverages. The packing containers are produced in automatic machines, to which the packing material is supplied in the form of packing container blanks which are converted to packing containers subsequently filled and then closed in the machine. The packing container blanks are made of flexible, but relatively dimensionally stable, material, e.g. a packing laminate which comprises a central carrier layer of fibrous material, e.g. paper, which is coated on either side with liquid-tight, thermoplastic material. The packing laminate frequently also comprises further layers of e.g. different types of thermoplastics, e.g. polyethylene or gas-tight layers of e.g. aluminium foil. The packing container blanks are cut out with such contours that they can be converted without further cutting or other similar machining to finished packing containers. The packing blanks are also frequently preformed inasmuch as they are folded and provided with a longitudinal, liquid-tight seal. The packing container blanks so preformed have a substantially square cross-sectional shape but are flattened for practical reasons during storage, transport and other handling. In this way the packing container blanks require a minimum of space for storage and transport prior to conversion to packing containers in the packing machines. The packing machine must then be provided with an arrangement for the raising of the flattened packing container blanks before the same are given their ultimate container shape by folding and sealing of one end of the tubular blank, filling of the container so formed with the required contents and folding and sealing of the opposite, top end of the packing container to a liquid-tight top with an integral opening arrangement.

A number of arrangements for the raising of flattened packing container blanks are known already. These arrangements are located in the loading portion of a packing machine and are adapted so as to receive one packing container blank at a time from the output end of a magazine wherein the flattened packing container blanks are stacked on top of one another. After the manual loading into the magazine of a number of packing container blanks at a time, the same are moved successively towards the outlet end where they are gripped by the raising device of the packing machine which, generally with the help of suction heads, converts the packing container blank so that it recovers its substantially square cross-sectional shape and transfers it to a conveyer to be passed onto a mandrel-wheel situated in the packing machine where the forming of the package bottom takes place. Known raising devices generally function in a reliable manner but are subject to certain disadvantages. Certain types of raising devices e.g. operate with the help of rotating drivers which during the rotation carry along and successively convert the packing container blanks. This type of raising devices consequently will require a good deal of space. Other known raising devices operate instead with a reciprocating movement which makes it possible to construct the arrangements in a more space-saving manner. However, these types of raising devices in general are much slower and cannot be used in machines with a high capacity. Both the known arrangements described have the further decisive disadvantage that they can operate with packing container blanks which are supplied from a magazine. On account of this, among other things, one magazine is required at each loading station in the packing machine which creates a large space requirement. Moreover, the filling of the magazines with packing container blanks is inconvenient and time-consuming.

OBJECTS OF THE INVENTION

It is an object of the present invention to provide a system for the transport and raising of packing container blanks in connection with the loading of the packing container blanks onto the mandrel-wheel of the packing machine, this system being able to handle the packing container blanks which are supplied one by one along a supply path.

It is a further object of the present invention to provide a system of this type which is compact and requires little space and which can be placed therefore immediately adjoining the loading station for the direct transfer and raising of individual packing container blanks.

It is a further object of the present invention to provide a system for the transport and raising of packing container blanks, this arrangement being simple and reliable in its construction and lacking the abovementioned disadvantages.

SUMMARY OF THE INVENTION

These and other objects have been achieved in accordance with the invention in a system for the transport and raising of flattened, tubular packing container blanks which comprises a conveyer for the feeding of blanks to co-operating, stationary gripping elements of which at least one is movable between a first, open position, in which it is adapted to receive a flattened blank from the conveyer and a second position in which the blank is converted to a raised form with a substantially square cross-section.

Preferred embodiments of the arrangement in accordance with the invention have been given, moreover, the characteristics which are evident from the subsidiary claims.

By designing in accordance with the invention a transport and raising system for packing container blanks with a conveyer and a number of pairs of gripping elements co-operating with the same, it becomes possible to supply flattened packing container blanks to a central magazine from which they are distributed and transferred whilst at the same time being raised to different loading points at the mandrel-wheel of the packing machine. The simple and effective design of the raising arrangements with co-operating gripping elements makes it possible to place the same in the desired number alongside a conveyer which supplies the packing container blanks one at a time. Moreover, the gripping elements can pick up the flattened packing container blanks directly from the conveyer and transfer them in conjunction with the raising to feeding devices for the mandrel wheel of the packing machine, so that no further transfer devices are required.

The system in accordance with the invention will now be described in more detail with special reference to the attached schematic drawing which only shows the details required for an understanding of the invention.

DETAILED DESCRIPTION OF THE INVENTION

Figure 1A:
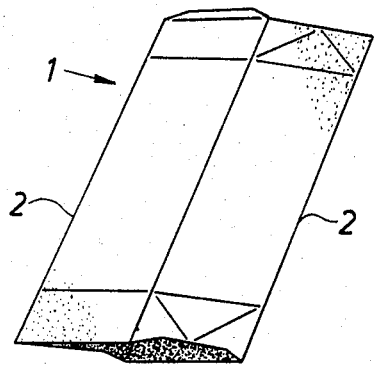
FIGS. 1A and B shows the type of packing container blank which the system of the present invention is intended to handle in flattened and in raised position respectively.
Figure 1B:
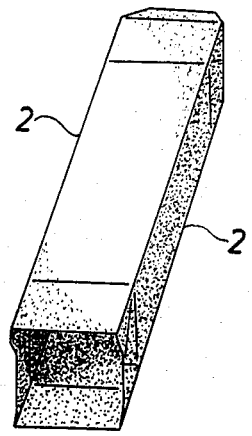

The packing container blank of the type which is shown in FIG. 1 is used for the manufacture of packing containers for e.g. milk. The packing container blanks are made of a flexible, but dimensionally stable, laminated material, e.g. a laminate which comprises layers of paper and plastics. After the laminate has been cut to the desired shape and has been provided with crease lines to facilitate folding and forming of the laminate, two longitudinal edges are sealed together so that the laminate is converted to a packing container blank 1 of tubular cross-section. Subsequently the packing container blank is flattened by folding along two longitudinal crease lines 2. In flattened condition the packing container blank can be readily transported, kept in a magazine or stored. Before conversion to a packing container the packing container blank is raised so that it recovers its tubular form and obtains a substantially square cross-section (FIG. 1B). When the packing container blank has been given this shape it is locked into the packing machine successively to be converted to a filled and closed packing container. In known packing machines the raised packing container blank is usually applied to a mandrel-wheel during the rotation of which the packing container blank, by means of folding and sealing is provided with a tightly closing bottom. Thereafter the packing container blank is transferred to a conveyer in which it passes a filling station where filling with the desired contents takes place. After the filling the top of the packing container is folded together and sealed, whereupon the packing container is finished. The packing container blank, its shape and manufacture as well as the packing machine for the conversion and filling of the packing containers are all well-known and need not be described in any detail in the present context. The parts which are essential for an understanding of the system in accordance with the invention are illustrated in greater detail in FIG. 2. The system shown comprises a magazine 3 for packing container blanks 1 which are supplied to the magazine in flattened condition from the top so that a stack of blanks results. At the bottom end of the magazine 3 there is a rotating feed-out device 4 which during operation of the system rotates and feeds out one packing container blank at a time to a feeding conveyer 5. The feeding conveyer comprises a conveyer band 6 in the form of a chain or belt which is provided with drivers 7 spaced equidistantly. If the conveyer band 6 is constituted of a chain, guide rails are arranged along the active upper part of the chain so as to prevent the blanks from coming into direct contact with, and possibly be damaged by, the chain. On belt conveyers the blanks can be placed directly on the belts, the guide rails in this case being omitted. The conveyer band 6 is driven by means of a motor (not shown) and runs over pulleys 8. At the lefthand end of the feeding conveyer 5 a pressure roller 9 is arranged above the conveyer band 6 which is suspended so that it can freely rotate and serves for pressing the packing container blanks 1 fed out from the magazine 3 against the conveyer band 6 of the feeding conveyer 5. After a packing container blank 1 which has been fed out has passed the pressure roller 9 it is captured by the drivers 7 of the conveyer band 6 and carried along in the direction towards the right in FIG. 2.

Figure 2:
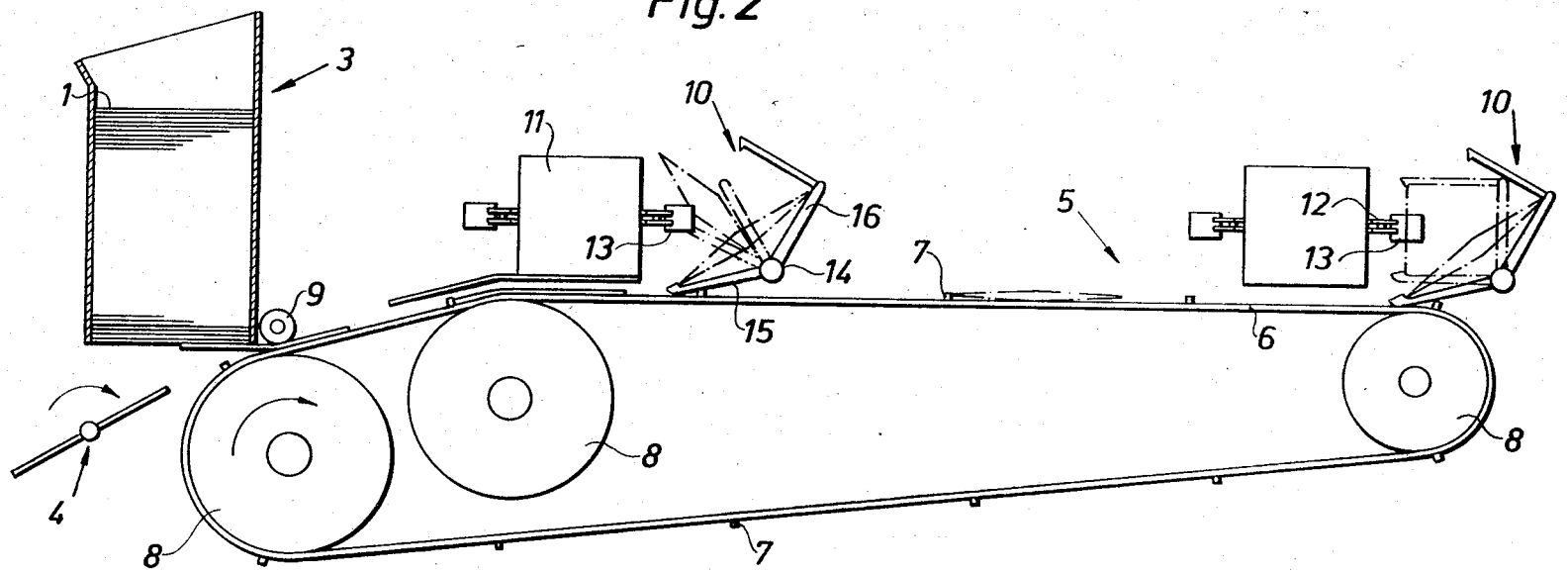
FIG. 2 is a side elevation which shows schematically a system in accordance with the invention together with co-operating parts of a packing machine.

Along the upper part of the feeding conveyer 5 are arranged a number of co-operating gripping elements 10. In FIG. 2 two pairs of gripping elements are shown which are situated along the upper part of the feeding conveyer 6 at a mutual distance which corresponds to the distance between two mandrel-wheels (not shown) in the packing machine with which the arrangement in accordance with the invention is intended to co-operate. The two co-operating pairs of gripping elements 10 are mutually identical, so that only one of them will be described in detail. At each pair of gripping elements 10, moreover, a loading conveyor 11 is provided which extends at a substantially right angle to the feeding conveyer 5.

The loading conveyers 11 are arranged axially in line with the position in which the mandrels of the packing machine stop during the intermittent rotation of the mandrel-wheel, so that a packing container blank advanced by means of the loading conveyer 11 can be pushed directly onto a mandrel placed in loading position. The loading conveyer 11, just like the feeding conveyer 5, is provided with a conveyer band 12 in the form of a chain or belt which is provided with drivers 13 in the form of projecting plates spaced equidistantly.

With each loading conveyer 11 is provided as mentioned earlier a co-operating pair of gripping elements 10. The gripping elements 10 on the one hand comprise primary arms 15, on the other hand secondary arms 16 whereof, depending on the particular design, either only the primary arms 15 or the primary as well as the secondary arms are adapted so that they can swivel about an axle 14 which extends parallel with the plane of movement of the loading conveyer 11 and thus at right angles to the conveyer band 6. The design and the function of the different arms will be described in more detail with special reference to FIG. 3.

Figure 3A:
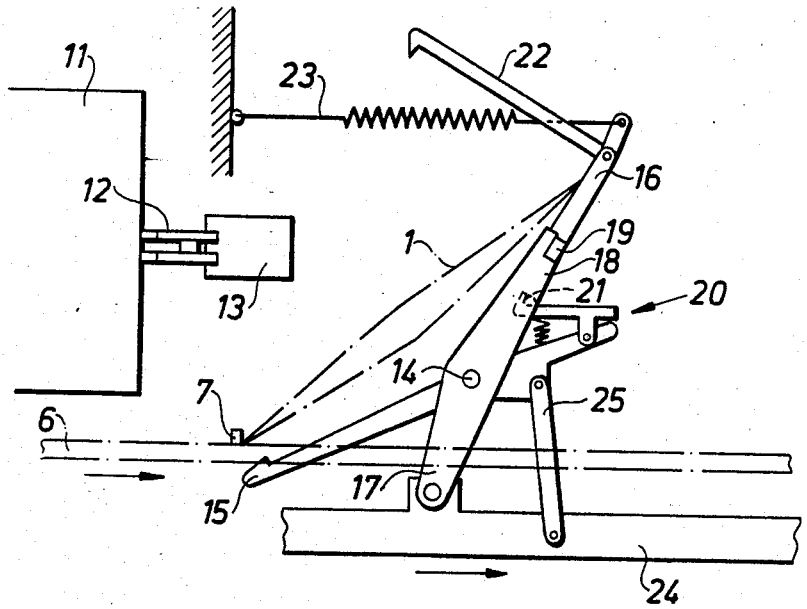
FIGS. 3A, B and C show on a larger scale a first embodiment of the system in accordance with the invention in three different positions during raising of a packing container blank.

In FIG. 3 which shows a first embodiment of the system in accordance with the invention, the gripping elements 10 are shown on a larger scale and it can be clearly recognized how the primary arms 15 as well as the secondary arms 16 are supported so that they can swivel about the axle 14. The axle 14, which is supported in a manner not illustrated in the figure in the machine frame, supports a further pivotable lever 17 whose other end serves as a return arm 18 for the secondary arm 16. The return arm 18 is placed right out on the one end of the axle 14 and is thus outside the end of the packing container blank 1, so that the return arm 18 does not in any position come into contact with the blank. The return arm 18 acts indirectly, though, upon the secondary arm 16 via a lip 19 projecting from the same by means of which the return arm 18 and the secondary arm 16 can be coupled together in a manner which will be described in greater detail in the following. The primary arm 15 and the secondary arm 16 too can be coupled together. This can be done by means of a spring-loaded detent 20 which is supported on the primary arm 15 so that it can swivel and which is adapted so as to engage with a stud 21 projecting from the secondary arm 16. In the embodiment shown, moreover, a hook 22 arranged at the upper end of the secondary arm 16 is provided whose length corresponds to the width of one side of the packing container blank. The rear part of the hook 22 forms an angle and extends substantially in the longitudinal direction of the secondary arm 16. A tension spring 23 connects the rear end of the hook with the frame of the arrangement and thus acts upon the hook 22 so as to urge the same to swivel downwards. The hook 22 will thus come to lie against a lip (not shown) arranged on the secondary arm 16 which prevents a swivelling movement of the hook in the position shown in FIG. 3A so that the force of the spring 23 is transferred to, and acts upon, the secondary arm 16 too so as to urge it to swivel towards the left in FIG. 3.

The upper part of the feeding conveyer 5 is illustrated by means of a dash-dotted line in FIG. 3. Underneath the same is a manoeuvering element 24 which is movable to and fro substantailly parallel with the direction of movement of the feeding conveyer 5. The manoeuvering element 24 is in hinged connection on the one hand with the lever 17 and on the other hand via a link 25 with the rear end of the primary arm 15. The manoeuvering element 24 is moved to and fro in rhythm with the movement of the feeding conveyer 5 with the help of a driving arrangement (not shown) which via a cam connects the manoeuvering element 24 to an electric driving motor which also drives the feeding conveyer 5.

As mentioned earlier, the system in accordance with the invention is intended to be used in a packing machine which converts packing container blanks to filled and closed packing containers. To this end the system transfers and raises flattened packing containers from the magazine 3 to the mandrel-wheel (not shown) of the packing machine. The flattened packing container blanks 1 are supplied manually or automatically to the magazine 3 during operation so that the feed-out device 4 on clockwise rotation will enegage with, and feed out, one packing container blank at a time from the output end of the magazine to the upper part of the feeding conveyer arranged directly adjoining the bottom end of the magazine 3. The conveyer band 6 of the feeding conveyer 5 during operation runs at uniform speed towards the right in FIG. 2 and in so doing passes the pulley 8 which is situated close to the feed-out device 4. When a packing container blank 1 has been pushed a little towards the right by the feed-out device 4 its front edge, seen in the direction of movement, comes to be located between the conveyer band 6 running over the pulley 8 and the pressure roller 9, and the packing container blank, owing to engagement with the conveyer band 6, will be carried towards the right in FIG. 2. After the packing container blank has passed the pressure roller 9 it is gripped by one of the drivers 7 on the conveyer band 6 so that the blank follows the conveyer band in an accurately defined position immediately in front of the driver 7. This accurately defined placing of the packing container blanks along the upper part of the conveyer band 6 is necessary for the continued function of the arrangement, since the gripping elements 10 are driven in a reciprocating movement which is accurately synchronized with the continuous movement of the conveyer 5.

Owing to the stiffness and dimensional stability of the packing laminate the packing container blank 1 substantially retains its flattened shape during the transport on the feeding conveyer 5. As mentioned earlier, a number of co-operating gripping elements 10 are provided along the active part of the conveyer band 6 which by turns remove one packing container blank from the feeding conveyer 5 for raising and further transport to the mandrel-wheel of the packing machine. In the embodiment shown in FIG. 2 there are two gripping elements 10 situated at a distance from one another, each of which thus manipulating and processing every other packing container blank advanced along the conveyer band 6. Hence when the particular packing container blank has arrived at the gripping element which is ready to manipulate the packing container blank, this gripping element is in the position as shown in FIG. 3A. The two arms 15,16 of the gripping element are open to their maximum, that is to say they are maximally swivelled away from one another. When this happens the outer end of the primary arm 15 will extend down into the path of the feeding conveyer 5 so that the blank advanced by the conveyor can be pushed up by the driver 7 with its front edge seen in the direction of movement along the primary arm 15 and then further along the surface of the secondary arm 16. Each gripping element 10 appropriately comprises a number of arms 15,16 arranged adjoining one another which jointly cover the whole width of the conveyer band 6 or in any case the width which corresponds to the length of the particular packing container blank. The arms 15,16 are arranged alternately along the axle 14 at such a distance that the primary arms 15 can extend down between the different individual belts or chains forming the conveyer band 6 which likewise are arranged at a small distance from one another.

During the continued movement to the right in FIG. 3A of the feeding conveyer 5 the particular packing container blank 1 will be pressed up with its front end against the upper end of the secondary arm 16 where the hook 22 forms a stopping surface for the container blank 1. A stopping surface, or catch, is also defined at the free end of the primary arm 15. As mentioned earlier the movement of the manoeuvering element 24 is synchronized with the feeding conveyer 5 which means that during the movement described by the packing container blank the manoeuvering element 24 is moved towards the right in FIG. 3A. As a result the primary arm 15 is acted upon via the link arm 25 so that it is swivelled clockwise from the position shown whilst at the same time the lever 17 and the return arm 18 are swivelled in anticlockwise direction. The movement is synchronized so that the primary arm 15 will come to lie against the edge of the packing container blank resting against the driver 7 at the same time as the driver 7 is on a level with the recess or hook provided at the outer end of the primary arm 15. At this the primary arm 15 commences to lift the packing container blank 1 from its engagement with the driver 7 which, owing to the uninterrupted movement of the feeding conveyer 5, is then moved further to the right in FIG. 3.

Figure 3B:
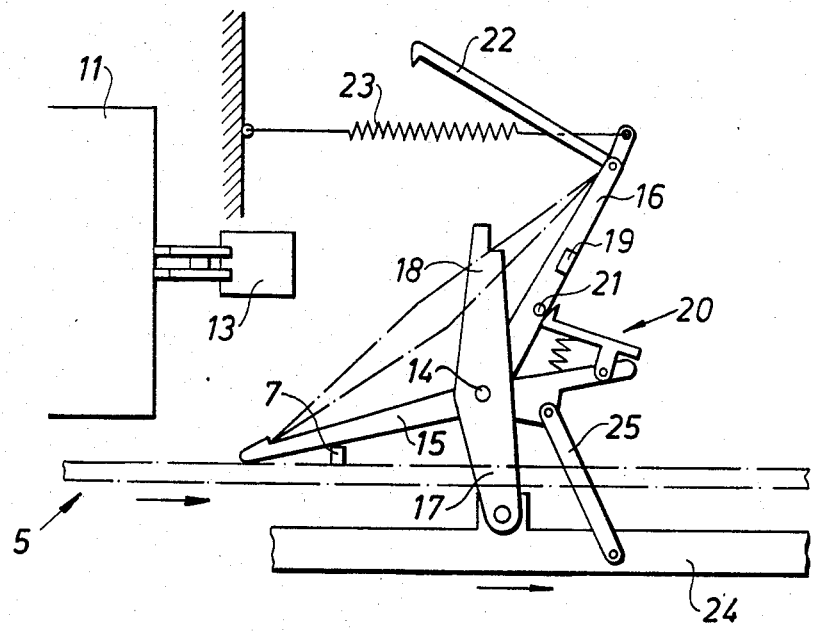

The clockwise movement of the primary arm 15 is transferred via the detent 20 also to the secondary arm 16. As soon as the primary arm 15 has come into contact with the rear edge of the packing container blank 1 and has lifted the same out of its engagement with the driver 7, the detent 20 will be released, however, owing to the rear end of the spring-loaded catch coming into contact with the primary arm 15 so that the swivelling movement caused by the spring of the detent and the engagement with the stud of the secondary arm 16 maintained thereby are interrupted. When the stud 21 has been freed, the spring 23 between the machine frame and the secondary arm 16 will swivel the secondary arm 16 anticlockwise. This swivelling movement is illustrated in FIG. 3B where the different arms of the gripping element are in the position they assume directly after the detent 20 has freed the secondary arm 16. The figure shows how the manoeuvering element 24 has been moved a further small distance to the right which via the link 25 has caused a further clockwise swivelling of the primary arm at the same time as the return arm 18 has assumed a substantially vertical position. During this movement the packing container blank held between the recess of the primary arm 15 and the angle between the secondary arm 16 and the hook 22 will be successively converted from a substantially flattened condition via a rhombic cross-sectional shape to a square cross-sectional shape which is illustrated in FIG. 3C.

Figure 3C:
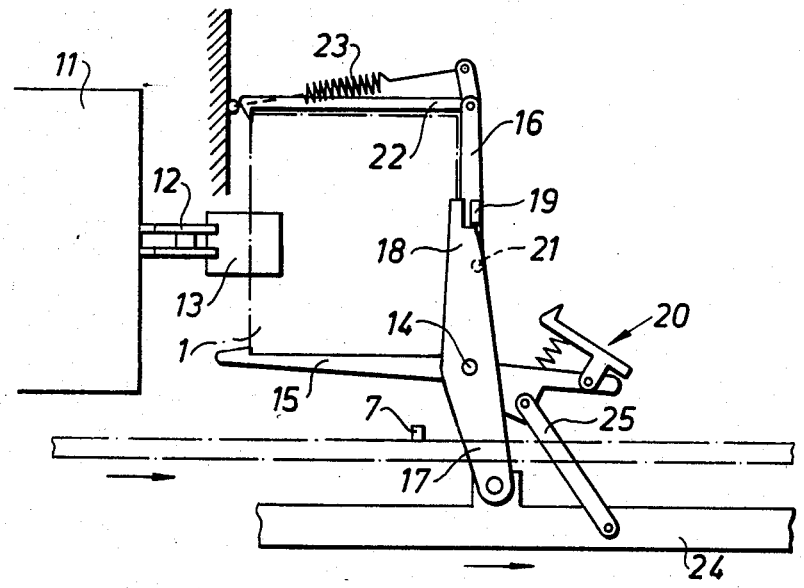

In FIG. 3C the movement of the manoeuvering element 24 has stopped as the manoeuvering element has arrived at its reversal position. In this position the manoeuvering element has swivelled the primary arm 15 to the substantially horizontal position shown, whilst the return arm 18 has been swivelled a little farther anticlockwise so as not to prevent the anticlockwise swivelling of the secondary arm 16 caused by the spring 23. The hook 22 of the secondary arm 16 has engaged with the free edge of the packing container blank, which stabilizes the shape of the blank and ensures that the blank remains in position between the primary arm 15 and the secondary arm 16. It is further evident from the figure how the blank, after it has assumed a square cross-sectional shape, extends with one side into the path of movement of the driver 13 of the loading conveyer 11, which is thus able to make contact with the raised packing container blank and to move it through axial displacement of the same out of the engagement with the gripping element 10, and to transfer it with the help of guide rails arranged along the loading conveyer 11, not shown in the figure, to a mandrel for further processing in the packing machine. For a correct function a synchronization of the movement of the loading conveyer 11 with the movement of the gripping elements 10 as well as with the feeding conveyer 5 is of course required which in practice is achieved by driving all the units from a common source of power.

In the embodiment described the manoeuvering element 24 commences its return movement (towards the left in FIG. 3) as soon as a raised packing container blank 1 has been removed by the loading conveyer 11 from the range of the gripping element 10. During the return movement the manoeuvering element 24 will swivel the return arm 18 via the lever 17 in clockwise direction. As a result the outer end of the return arm will come to rest against the lip 19 fitted on the secondary arm 16 so that the secondary arm 16 is driven in clockwise direction until it engages with, and is retained by, the detent 20 in open position. At the same time the primary arm 15 is swivelled via the link 25 in anticlockwise direction until, synchronously with the movement of the feeding conveyer 5, it extends down again between the individual chains or belts which together form the conveyer band 6 of the feeding conveyer 5. The packing container following next can then be picked up from the feeding conveyer and a renewed raising and transfer cycle is started.

The system described is suitable for the transfer and raising of packing material blanks of the design shown in FIG. 1. However, since packing material blanks may be manufactured from numerous different material types and material combinations it is necessary to carry out a so-called overfolding so that the raised packing container blank will retain its substantially square cross-sectional shape. This has to do with the fact that certain packing laminates have an inherent flexibility which means that the packing laminate blank, after having been stored for a prolonged period in flattened condition, tends after it has been converted to a raised position to resume its rhombic cross-sectional shape. To counteract this tendency a so-called overfolding is carried out, which means that the packing container blank is raised from its flattened condition not only until a square cross-sectional shape has been obtained, but that it is overfolded as well so that an opposite rhombic cross-sectional shape is obtained before the raising effort has been concluded. In accordance with the invention this process too can be carried out with the help of the arrangement described. In contrast to the procedure described earlier, the movement of the manoeuvering element 24 here is not discontinued in the position which is shown in FIG. 3C, but the manoeuvering element 24 is allowed to move over a further small distance to the right. The clockwise swivelling of the primary arm 15 will then continue over a further approx. 30° whilst the return arm 18 swivels anticlockwise over a corresponding angle. As a result the spring 23 can carry the secondary arm in anticlockwise direction until the primary arm 15 and the secondary arm 16 together impart to the packing container blank 1 an oppositely directed rhombic cross-sectional shape. It is of great importance that during the overflowing operation the hook 22 should be in engagement with the third edge of the packing container blank, that is to say the free edge which is situated between the edges with which engage the primary and secondary arms respectively, since otherwise, owing to the springiness of the material and the diminished angle between the primary and secondary arm, the blank will tend to slide out of the gripping element. After the oppositely directed rhombic cross-sectional shape has been imparted to the packing material blank, the movement of the manouevering element 24 is stopped and its return movement commences. The primary and the secondary arms will again be swivelled away from one another until they assume the position shown in FIG. 3C. The packing container blank 1 now has a square cross-sectional shape again and thus can be transferred via the loading conveyer 11 to the mandrel-wheel of the packing machine. The overfolding carried out in this manner means that the packing container blank will retain its square cross-sectional shape better during transport and handling up to the final forming and sealing. The recesses and hooks described in or on the arms of the gripping element 10 can be substituted in certain cases by other elements which prevent the blank from sliding out of the gripping elements during handling, e.g. fixed support cams which co-operate with the arms.

Figure 4A:
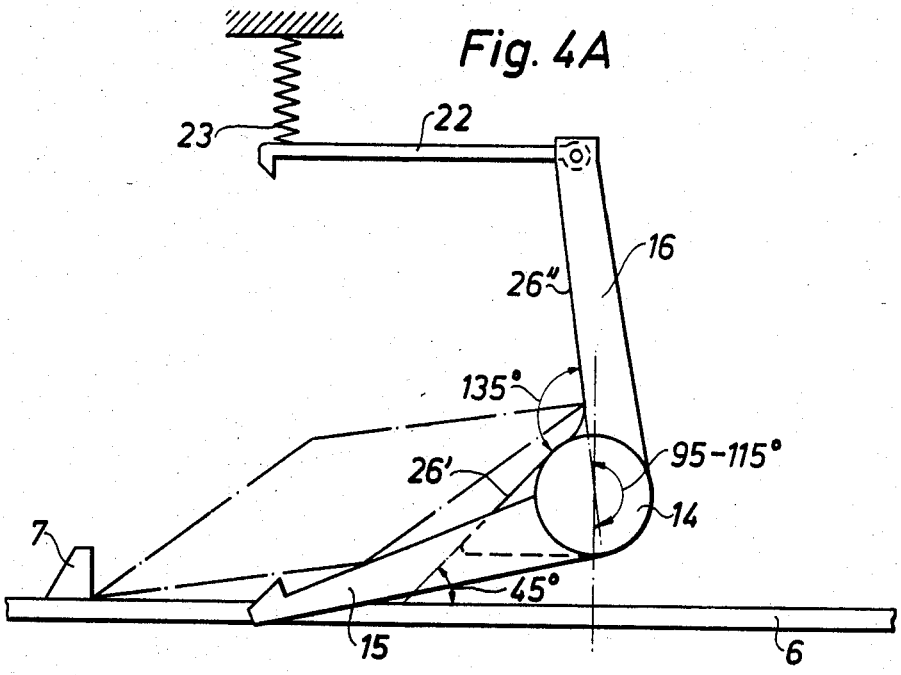
FIGS. 4A, B and C show on a larger scale a second embodiment of the system in accordance with the invention in three different positions during raising of a packing container blank.

The second embodiment of the system in accordance with the invention shown in FIGS. 4A, B and C differs from the first-mentioned embodiment first and foremost because here the secondary arm 16 is fixed. As a result the parts of the manoeuvering arrangement which in the first embodiment described eariler are used for the manoeuvering of the secondary arms and the synchronizing of the movement of the two arms can be omitted. This considerably simplifies the construction and so excercises a positive influence on the cost of manufacture as well as on the reliability.

The second embodiment of the system in accordance with the invention is thus substantially of the same design as the first embodiment apart from the components which are made superfluous because of the secondary arm now being immovable. A detailed description of the design is made by reference to FIGS. 3A, B and C with the associated text. The reference numerals to corresponding parts are identical in FIGS. 3 and 4.

Insofar as the design of the fixed secondary arm is concerned, this differs in numerous important aspects from the form of the movable secondary arm. Both embodiments of the secondary arms may consist of a wholly platform-like part or of a number of substantially identical parts situated at a distance from one another. The surface of the secondary arm co-operating with the packing container blank (hereinafter called sliding surface), which thus can be distributed over several arm components, is concave or curved when the secondary arm is fixed. This shape is chosen so that during the operation of the arrangement the curvature of the surface provides the front edge of the blank with a path of movement which substantially corresponds to the path of movement which in the earlier embodiment was obtained through the combination of a secondary arm with a substantially straight sliding surface and the swivelling movement of the arm adapted to the rate of feed of the blank.

The sliding surface of the fixed secondary arm more particularly has a bottom part situated adjoining the upper part of the conveyer which extends upwards at an angle of substantially 45° seen in the direction of movement of the part and an upper part which extends at 95°–115° to the direction of movement of the said part. The exact angles will depend on different factors such as the stiffness of the blank processed, the friction between the sliding surfaces etc. and has to be determined by practical experiments and adjustment of the correct position of the secondary arm. This embodiment implies that the upper and lower part of the sliding surface between them will form an angle of preferably approx. 135°. This means that during operation of the arrangement the front edge of a blank fed is retarded occasionally at the transition bewteen the upper and lower part of the sliding surface. The continued feed of the rear edge of the blank then has the effect that a conversion from flattened to rhombic shape takes place already during the movement of the blank up the sliding surface of the secondary arm, which is not the case in the first embodiment where the conversion by and large will take place only after the front edge of the blank has arrived at the upper end of the secondary arm.

During operation of a system designed according to the second embodiment in accordance with the invention a flattened packing container blank, which is fed through engagement between the driver 7 of the conveyer band 6 (FIG. 4) and the rear edge of the blank, arrives with its front edge at the primary arm 15 of the gripping element. The gripping element is then open to its maximum, that is to say the primary arm 15 is maximally swivelled out so that its outer end extends down into the path of the feeding conveyer. The blank can be pushed up, therefore, along the primary arm 15 and further along the sliding surface 26 of the secondary arm 16. During the continued movement of the conveyer 5 the blank 1 with its front end edge will slide further along the lower part of the sliding surface 26 and gradually approach the relatively strongly curved transition between the lower 26' and the upper 26" part of the sliding surface. Since the front edge of the blank is then retarded for a short instant, the continued movement will reduce the distance between the driver 7 and the said transition zone of the sliding surface which forces the blank to be opened so that it obtains a marked rhombic cross-sectional shape. The conversion means that the distance between the rear and the front edge of the blank is reduced. The front edge is then given the opportunity of continuing the movement along the upper part of the sliding surface until it approaches the angle between the sliding surface 26" and the hook 22. At the same time the primary arm 15 has been swivelled in clockwise direction so that it arrives above the upper part 6 of the conveyer and thereby engages with, and lifts, the rear edge of the blank out of engagement with the driver 7.

Figure 4B:
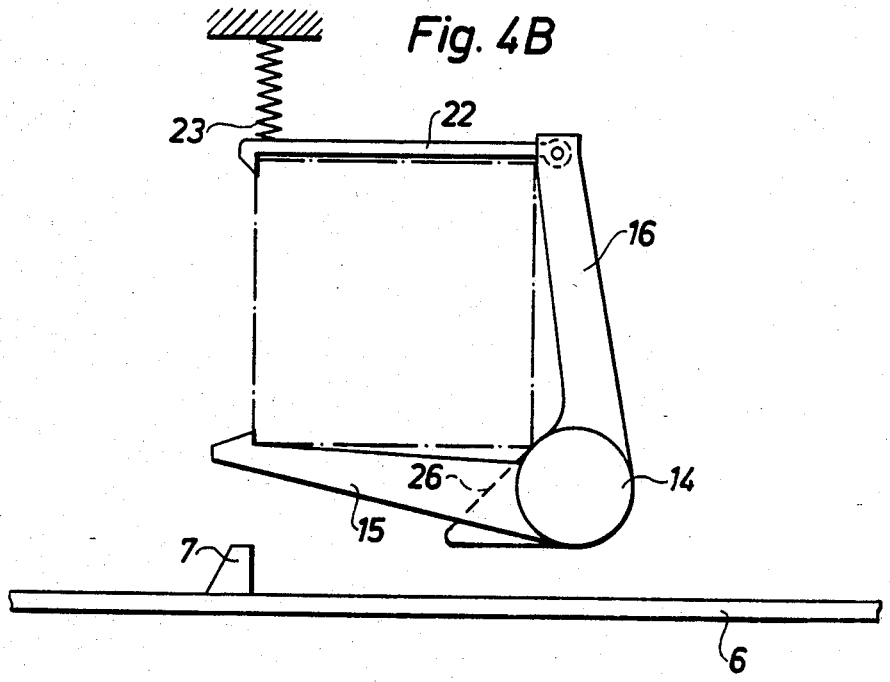
Figure 4C:
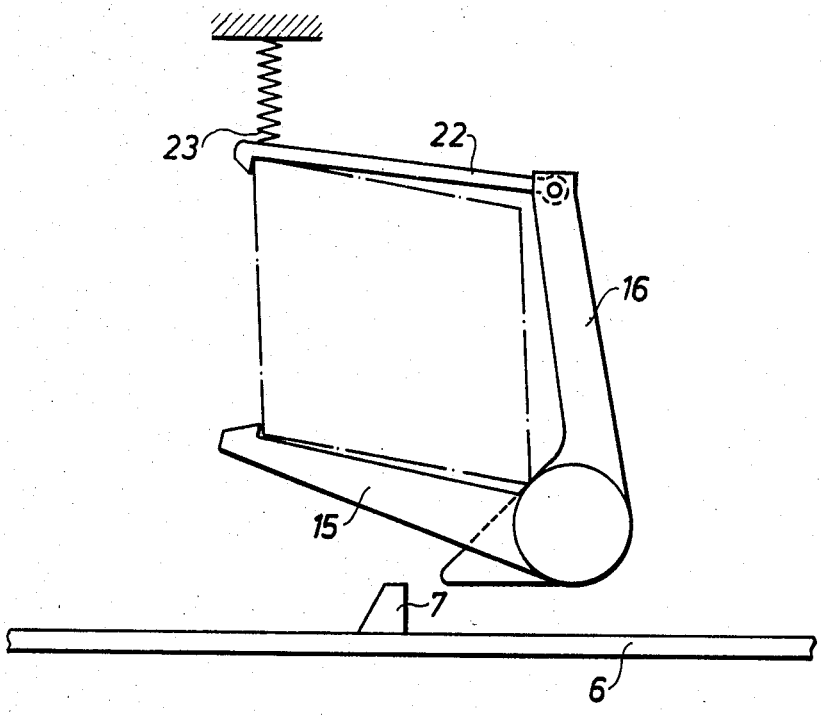

The ultimate conversion of the blank to a square cross-sectional shape takes place now in that the primary arm is swivelled up to a position parallel with the conveyer, which means that the upper part of the blank will rest against the hook 22. In this position the blank has a square cross-sectional shape and the raising can be regarged as finished (FIG. 4B). However, as mentioned previously, it is desirable to "overfold" the blank so that its square cross-sectional shape will be retained better. This can be carried out in a simple manner with the help of the arrangement described. However, in contrast to the procedure described earlier, the movement of the primary arm 15 is not interrupted in the position which is shown in FIG. 4B, but the arm is allowed to swivel over a further approx. 30° clockwise until the packing container blank 1 obtains an oppositely directed rhombic cross-sectional shape (FIG. 4C). It is of great importance that during the overfolding operation the hook 22 should be in engagement with the third edge of the packing container blank, that is to say the free edge which is situated between the edges with which engage the primary and secondary arm respectively, since otherwise, owing to the springiness of the material and the diminished angle between the primary and secondary arm, the blank will slide out of the gripping element. After the oppositely directed rhombic cross-sectional shape has been imparted to the packing material blank, the movement of the primary arm 15 is discontinued and it is swivelled back until it assumes the position shown in FIG. 4B. The packing container blank 1 now has a square cross-sectional shape and thus can be transferred via the loading conveyer 11 to the mandrel-wheel of the packing machine.

The design of the working surface of the secondary arm may be varied and adapted to the size and type of the packing container blank which is to be processed. The type of blank described in the introduction with a final contents volume of 1 liter has a panel width of approx. 70 mm and thus a total distance (in flattened condition) between opposite folding edges (that is to say the "front" and the "rear" edge seen in the direction of movement of the blank through the system in accordance with the invention) of approx. 140 mm. On working with this type of blank it has been found appropriate to give the bottom part of the working surface of the secondary arm a length (along the path of movement of the front edge of the blank) of approx. 40 mm and an angle of between 35° and 55°, preferably 45° in relation to the plane of movement of the upper conveyer. This slope makes it possible for the blank gradually to slide up along the sliding surface until the front edge is temporarily retarded at the transition between the lower and upper part of the sliding surface. This transition is designed appropriately with a radius of approx. 10 mm. The upper part of the sliding surface has a length of approx. 60 mm and a slope of 95°–115° preferably 135° in relation to the said plane.

The abovementioned dimensioning of surfaces and angle has been found in practice to function well and allow a high rate of conversion (3–4000/h), but it is evident that other values may be chosen if e.g. other types of blanks are to be processed, or a lower rate can be accepted. It is essential, though, that the shape of the sliding surface is such that the distance between the particular driver and the front edge of the blank is temporarily reduced in order to be increased again subsequently during the movement of the blank up the sliding surface.

The system in accordance with the invention described makes it possible to carry out a simple handling and raising of flattened packing container blanks within a very limited space which is a great advantage in modern, compactly built packing machines. Owing to a number of identical systems being able to operate from the same magazine, it becomes possible, furthermore, to feed the packing machine in a very rational and rapid manner which is particularly important in the case of high-capacity packing machines.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

I claim:

1. A system for delivering unfolded packing containers from a source of flattened, tubular packing container blanks, said system comprising a feeding conveyor for conveying flattened blanks from said source along a conveyor path and a set of gripping elements at a fixed location spaced from said source along said conveyor path, said conveyor moving past said set of gripping elements said set of gripping elements including at least one primary gripping element, at least one secondary gripping element extending above said conveyor path and means for pivoting said primary gripping element about an axis transverse to and above said conveyor path between an inclined position relative to said conveyor path and a second position above said conveyor path, said primary gripping element at said inclined position extending below said conveyor path and defining a guide from the conveyor onto said secondary gripping element, said primary gripping element pivoting toward said secondary gripping element as said primary gripping element moves to said second position so to unfold the blank and to position the blank above said conveyor path.

2. A system in accordance with claim 1, wherein the primary and secondary gripping elements comprise primary and secondary arms, respectively, each having at their outer ends catches adapted to engage edges of the container blanks.

3. The system in accordance with claim 2, wherein said system also comprises a plurality of said sets of gripping elements spaced apart along the conveyor path and adapted to pick up by turns blanks from said feeding conveyor.

4. The system in accordance with claim 3, wherein said source is a single magazine.

5. The system in accordance with claim 4, wherein each system also comprises a plurality of loading conveyors, each loading conveyor being positioned above and extending substantially at a right angle to said feeding conveyor path and leading to one of a plurality of packing machines, each set of gripping elements transferring blanks from said feeding conveyor to one of said loading conveyors.

6. The system in accordance with claim 5, wherein the gripping elements is placed at one end of the respective loading conveyer so that the blanks after unfolding and positioning by said gripping elements extend in the path of the loading conveyer.

7. The system in accordance with claim 2, wherein said means for pivoting the primary arm is synchronized with said feeding conveyor, the system also comprising means for pivoting the secondary arm toward said primary arm about said axis.

8. The system in accordance with claim 7, wherein the primary and secondary gripping arms are connected by a detent which is adapted so as to release the secondary arm only after the primary arm has moved from said inclined position toward said second position.

9. The system in accordance with claim 2, wherein the secondary arm is fixed and provided with a sliding surface for guiding the front edge of a blank toward the catch of the secondary arm as the blank is advanced by the conveyer.

10. The system in accordance with claim 7 or 9, wherein said primary gripping element can be pivoted to a third position closer to said secondary gripping element than said second position so to flatten the blank in an opposite direction to the original flattened form.

11. The system in accordance with claim 7 or 9 wherein said conveyor includes spaced driver elements for engaging the rear folded edge of a container blank.

12. The system in accordance with claim 9, wherein the sliding surface is concave.

13. The system in accordance with claim 12, wherein the sliding surface comprises a bottom part adjacent the conveyer path which bottom part extends upwardly at an angle of substantially 45° as seen in the direction of movement along said conveyer path, said sliding surface further comprising an upper part which extends in the range of 90° to 115° in relation to the direction of movement along the conveyer path.

14. The system in accordance with claim 13, wherein the angle between said lower and upper part of the sliding surface equals approximately 135°.

15. The system in accordance with claim 7 or 9 wherein said set of gripping elements also includes at least one third element pivotably attached to an upper end of said secondary arm, said third element having a hook at a free end which hook is adapted to engage a free edge of the packing container blank as said primary and secondary arms unfold said blank.

16. A system for delivering unfolded packing container blanks, said system comprising:

a magazine for containing a supply of folded packing container blanks;

a conveyor for conveying folded packing container blanks from said magazine along a path; and a plurality of stations at fixed, spaced apart locations along said path after said magazine, said conveyor moving past said stations, each station having: a secondary gripping arm defining a secondary catch above said conveyor for receiving a forward edge of a conveyed folded packing container blanks, a primary arm mounted for pivoting movement about a fixed axis transverse to and above said path from an inclined position relative to said path to a raised position above said path, said primary arm at said inclined position extending below the path of said conveyor and defining a guide onto said secondary arm for the conveyed folded packing container blank, said primary arm including a primary catch for engaging the trailing edge of the conveyed folded container blank, and means for reciprocating said primary arm from said inclined position to said raised position so to lift said packing container blank above said conveyor and to cooperate with said first gripping arm to unfold said packing container.

17. A catching device suitable for catching folded container blanks being moved along a first conveyor path by a conveyor moving past said catching device and for raising each caught blank above said conveyor path in an unfolded state, said folded container blanks having a forward folded edge and a trailing folded edge, said catching device comprising:

a secondary arm defining a secondary catch above said conveyor path for receiving the forward folded edge, said secondary arm having surfaces leading to said secondary catch;

a primary arm pivotable about an axis transverse to and above said conveyor path from an inclined position to a raised position, said primary arm at said inclined position intercepting said conveyor path at an incline and defining a guide onto said secondary arm, said primary arm including a primary catch for receiving the trailing folded edge, said primary catch being positioned below said conveyor path when said primary arm is at said inclined position, said primary catch being positioned above said conveyor path when said primary arm is at said raised position so as to unfold said container blank in cooperation with said secondary catch; and means for reciprocating said primary arm between said inclined and raised positions.

18. The catching device in accordance with claim 17, wherein said secondary arm is pivotable about said axis from a preset position furthest away from said primary arm and a holding position whereat said secondary arm cooperates with said primary arm to hold said packing container blank in an unfolded state;

detent means for releasably connecting said secondary arm to said primary arm so that said secondary arm is maintained at said preset position as said primary arm is at said inclined position, said detent means releasing said secondary arm from said primary arm as said primary arm is moved from said inclined position to said raised position; and means for biasing said secondary arm toward said holding position.

19. The catching device in accordance with claim 18, wherein said catching device further includes:

a return arm having a catch for releasably engaging said secondary arm, said return arm being pivotable about said axis from a first position spaced from said secondary arm at said holding position to a second position urging said secondary arm into said reset position; and means for reciprocating said reset arm between said first position and said second positions.

20. The catching device in accordance with claim 17, wherein the secondary arm is fixed.

21. The catching device in accordance with claim 19 or 20, wherein the device further comprises:

a third arm pivotably attached to an upper end of said secondary arm and having a hook adapted to engage a free edge of the container blank upon unfolding of the blank by said primary and secondary arms.

22. The device in accordance with claim 20, wherein said surfaces of the secondary arm include a lower portion extending upwardly at an angle of substantially 45° in relation to the direction of movement along said conveyor path and an upper portion extending upwardly at an angle in the range of 90° to 115° in relation to the direction of movement along said conveyor path.

23. The device in accordance with claim 22, wherein the angle between said lower and upper portions equals approximately 135°.

* * * * *